United States Patent [19]

Grodinsky et al.

[11] Patent Number: 5,070,530

[45] Date of Patent: Dec. 3, 1991

[54] ELECTROACOUSTIC TRANSDUCERS WITH INCREASED MAGNETIC STABILITY FOR DISTORTION REDUCTION

[76] Inventors: Robert M. Grodinsky, 4448 W. Howard, Skokie, Ill. 60076; David G. Cornwell, 3735 N. Ridgeway, Chicago, Ill. 60618

[21] Appl. No.: 173,435

[22] Filed: Mar. 25, 1988

Related U.S. Application Data

[63] Continuation-in-part of Ser. No. 33,418, Apr. 1, 1987, abandoned.

[51] Int. Cl.[5] ..... H04R 25/00

[52] U.S. Cl. ..... 381/201

[58] Field of Search ..... 381/168, 177, 189, 192, 381/194, 195, 199, 201; 335/231, 243, 244, 222, 281, 282; 310/13, 27

[56] References Cited

U.S. PATENT DOCUMENTS

| | | | |
|---|---|---|---|
| 1,703,926 | 3/1929 | Delano | 381/202 |
| 2,030,574 | 2/1936 | Dull | 381/194 |
| 2,134,047 | 10/1938 | Kalsey | 381/193 |
| 2,180,615 | 11/1939 | Serge | 381/199 |
| 2,801,294 | 7/1957 | Wurdel | 381/199 |
| 3,115,207 | 12/1963 | Wiggins | 381/177 |
| 3,116,377 | 12/1963 | Todt | 381/194 |
| 3,234,782 | 2/1966 | Grootenhuis | 310/27 |
| 3,450,930 | 6/1969 | Lien | 315/3.5 |
| 3,553,618 | 1/1971 | Lang | 335/244 |
| 3,632,904 | 1/1972 | Mauz | 335/231 |
| 3,665,352 | 5/1972 | Dietrich et al. | 335/231 |
| 3,838,216 | 9/1974 | Watkins | 381/195 |
| 3,881,127 | 4/1975 | MacMasters et al. | 335/296 |
| 3,898,393 | 8/1975 | Digre | 381/197 |
| 4,145,571 | 3/1979 | Cadawas | 381/158 |
| 4,293,741 | 10/1981 | Digre | 381/199 |
| 4,295,066 | 10/1981 | Lloyd | 310/30 |
| 4,315,568 | 2/1982 | Mojden | 335/306 |
| 4,327,257 | 4/1982 | Schwartz | 381/199 |
| 4,397,185 | 8/1983 | Craig et al. | 73/504 |
| 4,421,956 | 12/1983 | O'Neill | 381/194 |
| 4,425,482 | 1/1984 | Bordelon et al. | 381/202 |
| 4,438,297 | 3/1984 | Kawamura | 381/201 |
| 4,443,775 | 4/1984 | Fujitani et al. | 335/281 |
| 4,471,172 | 9/1984 | Winey | 381/199 |
| 4,492,827 | 1/1985 | Shintaku | 381/194 |
| 4,504,704 | 3/1985 | Ohyaba et al. | 381/195 |
| 4,529,846 | 7/1985 | Freeman et al. | 381/196 |
| 4,577,069 | 3/1986 | Keezer | 381/201 |
| 4,628,154 | 12/1986 | Kort | 381/199 |
| 4,661,973 | 4/1987 | Takahash | 381/199 |
| 4,692,732 | 9/1987 | Leupold et al. | 335/302 |
| 4,701,737 | 10/1987 | Leupold | 335/301 |

OTHER PUBLICATIONS

*Handbook of Sound Reproduction*, Audio Library, vol. II, Radio Magazines, Inc. 1957, pp. 76 & 82–83.

"*A to Z in Audio*" by G. A. Briggs, Gernshack Library, Inc., 1961, p. 122.

*Primary Examiner*—Forester W. Isen

*Assistant Examiner*—D. R. Byrd

*Attorney, Agent, or Firm*—Nicholas A. Camasto

[57] ABSTRACT

A loudspeaker includes a radially slotted ceramic permanent magnet for reducing distortion. Other constructions include slotted top and bottom plates and radially slotted bucking magnets, in combination with slotted magnet loudspeakers. The slotted bucking magnets may be retrofitted to conventional loudspeakers.

15 Claims, 2 Drawing Sheets

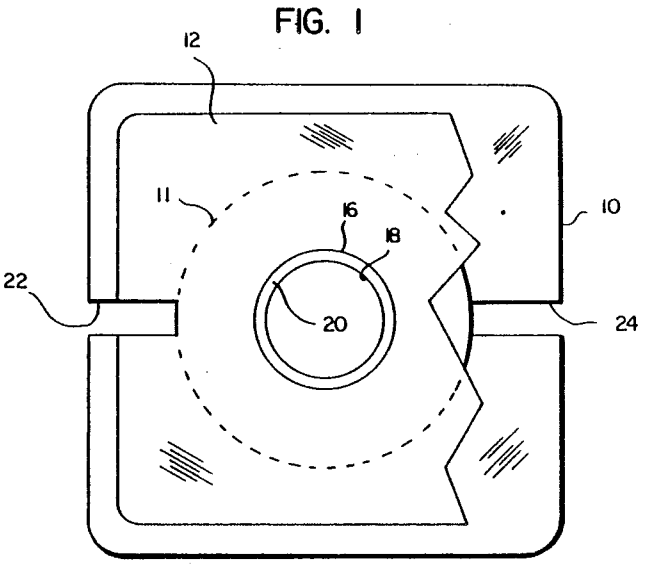
FIG. 1
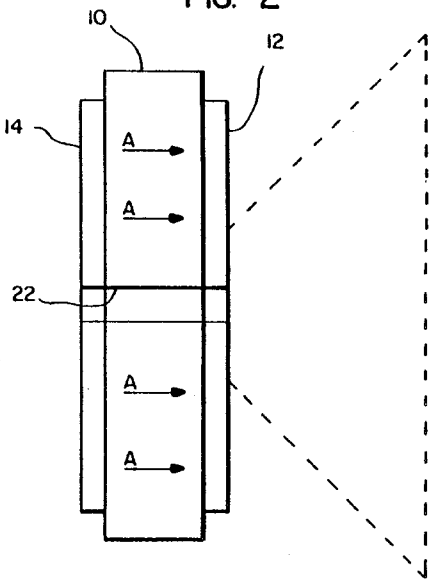
FIG. 2
RELATIVE LOSSES OF MAGNET STRUCTURES
8" DRIVERS, 8 OHM 1" VOICE COILS
| | 100 Hz | 500 Hz | 1KHz | 5KHz |
|---|---|---|---|---|
| STANDARD MAGNET | 1.0 | 0.294 | 0.243 | 0.50 |
| SLOTTED MAGNET & SLOTTED PLATE | 0.77 | 0.25 | 0.20 | 0.24 |
| SLOTTED MAGNET, SLOTTED PLATE, & SLOTTED BUCKING MAGNET | 0.74 | 0.20 | 0.172 | 0.21 |
FIG. 3
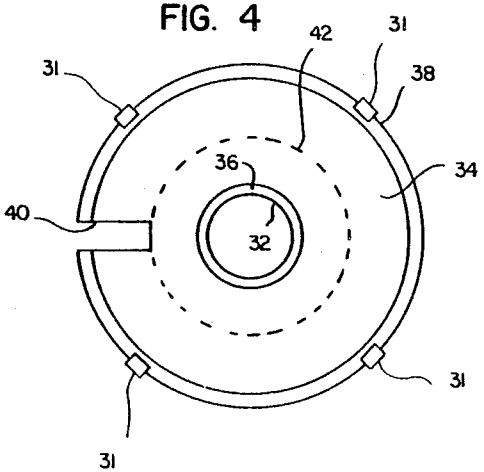
FIG. 4

ELECTROACOUSTIC TRANSDUCERS WITH INCREASED MAGNETIC STABILITY FOR DISTORTION REDUCTION

CROSS REFERENCE TO RELATED APPLICATION

This application is a continuation-in-part of application Ser. No. 033,418, filed 4/1/87, now abandoned, and is related to, but in no way dependent upon, copending application Ser. No. 866,357, filed 5/23/86, in the names of the present inventors and entitled DISTORTION REDUCTION IN MAGNETIC TRANSDUCERS, now abandoned.

BACKGROUND OF THE INVENTION AND PRIOR ART

The above-referenced copending application discusses observed differences between loudspeaker constructions utilizing non-conductive ceramic magnets and loudspeaker constructions utilizing alnico-type magnets and points out the general inferiority of the ceramic magnet structures. In particular, the effects of distortion due to eddy currents, in the top and bottom plates, which generate local magnetic fields that are coupled back to the voice coil are noted. These eddy currents produce harmonic distortion effects due to the non-linear iron characteristics as well as frequency selective, i.e., frequency dependent, distortion effects because the amplitudes of the eddy currents are proportional to frequency.

In the prior art, the effects of energy loss due to eddy currents in the conductive parts of an electroacoustic magnetic transducer motor structure have been misunderstood. For example, extra conductive material, generally in the form of copper, has been added to the motor structure to flatten the loudspeaker impedance characteristic, i.e., make the characteristic more uniform with frequency. The fact that the energy transferred into the conductive material reduces the energy that is transformed into useful loudspeaker diaphragm motion, and that this effect, which is non-uniform with frequency, results in a reduction in the accuracy of reproduction of transients, has either not previously been recognized or has been ignored. This frequency selective loss in prior art transducer constructions results in transducers with reduced ability to track the rapid changes in audio signals. Indeed, a flat impedance characteristic in a loudspeaker driver has been found to be of secondary importance and is even undesirable when it is produced by non-linear or frequency selective losses in any of the parts of the magnet structure.

It has been discovered that in addition to eddy current effects in ferromagnetic structure parts, ceramic magnets in contrast to alnico magnets, introduce another distortion component. Magnetic fields are introduced into the magnet material by the motion of the signal-carrying coil, whether in a loudspeaker or a microphone embodiment. This energy, which is effectively subtracted from the available useful energy, is proportional to coil travel and is thus inversely proportional to frequency. There are undesirable consequences associated with the phenomenon. For example, the signal-related AC magnetic energy that is induced into the magnet causes distortion. While the exact mechanism has not yet been proven, it is believed that the induced AC magnetic field modulates the DC field in the magnet.

The prior art also recognized the need for improved low frequency reproduction, but in failing to recognize the role of magnetic and eddy current losses as discussed above, attempted solutions that were incorrect and expensive. Attempts to boost low frequency output are exemplified in U.S. Pat. No. 3,838,216 to Watkins and U.S. Pat. No. 4,504,704 to Takashi et al. In these patents, a second voice coil and large value inductors and capacitors are used to form a frequency selective bass boost circuit. Besides the considerable expense of the extra parts and the construction, these circuits suffer from time displacement distortion due to the long time constants of the boost circuits. This results in bass reproduction that may be powerful, but is slow and inaccurate.

In the present invention, powerful, yet quick, accurate bass reproduction is achieved by the simple, inexpensive technique of slotting the ceramic magnet. A slotted ceramic magnet seems to function as a stabilizing means for reducing distortion caused by the signal related magnetic fields induced into the magnet. In a further aspect of the invention, it has been found that combining the slotted or split magnet construction with the split plate technology described in the above-mentioned copending application, produces results that surpass the expected combined contributions and represents a very attractive electroacoustic magnetic transducer construction.

In a still further aspect of the invention, a slotted "bucking" magnet and an additional slotted back plate, when added to both a conventional transducer and to a transducer incorporating a slotted magnet, produces very beneficial results.

OBJECTS OF THE INVENTION

A principal object of the invention is to provide an improved electroacoustic ceramic magnetic transducer.

Another object of the invention is to reduce distortion in electroacoustic ceramic magnetic transducers.

A further object of the invention is to provide a low frequency electroacoustic ceramic magnetic transducer with improved low frequency characteristics.

A still further object of the invention is to provide an improved full range loudspeaker.

Still another object of the invention is to provide means for improving the accuracy of reproduction of a conventional loudspeaker.

BRIEF DESCRIPTION OF THE DRAWINGS

Other objects of the invention will become apparent upon reading the following description in conjunction with the drawings in which.

FIG. 1 Is a representational drawing of a magnet structure according to the invention;

FIG. 2 is a partial side view of a loudspeaker having the magnet structure of FIG. 1;

FIG. 3 is a table illustrating relative losses as a function of frequency for a prior art magnet construction and for the present invention magnet structures;

FIG. 4 is a representational drawing of an alternative form of magnet structure.

DESCRIPTION OF THE PREFERRED EMBODIMENT

Figure 6:
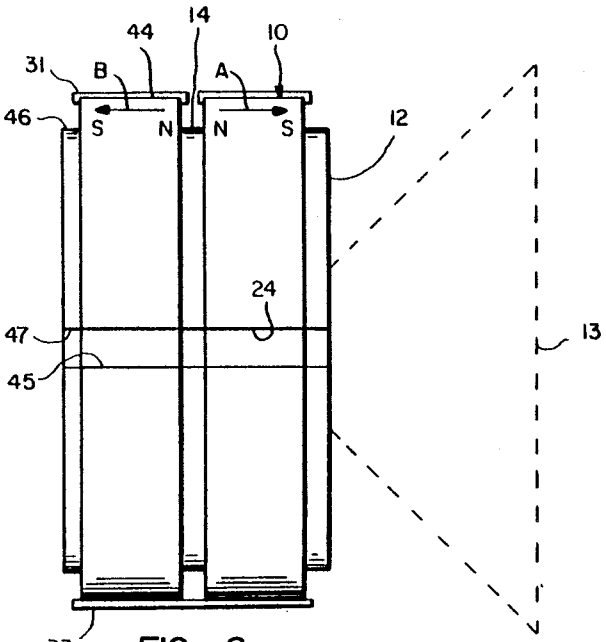
FIG. 6 is a representation of the invention utilized in a bucking magnet configuration with a loudspeaker having the magnet structure of the invention.

While the invention and its various aspects are described in connection with a ceramic magnet structure in a loudspeaker, it will be appreciated that the invention is equally applicable to such magnet structures in other electroacoustic transducers, such as microphones and headphones.

Referring to FIG. 1 and FIG. 2, there is shown a top and a side view of a square ceramic "ring" magnet structure in representational form. FIG. 2 indicates a loudspeaker cone structure 13 in dashed lines. The ceramic magnet 10 has a circular center opening 11. A steel top plate 12 and a steel bottom plate 14 are fixed to the opposite faces of magnet 10. The top plate 12 of FIG. 1 is shown partially cut away to reveal the underlying magnet structure. The magnet is poled in a direction perpendicular to the plane of the drawing of FIG. 1. The top plate 12 has a circular center hole 16 in which a steel pole piece 18 is centered to form a circular air gap 20 between top plate 12 and the pole piece 18. Bottom plate 14 is affixed to the other end of pole piece 18 in a conventional manner. The magnet 10 contains two radial slots 22 and 24 which divide it into two sections. Top plate 12 and bottom plate 14 are partially slotted such that their areas substantially match the open areas of the slots 22 and 24 in the magnet. In FIG. 1, the second slot in top plate 12 is not visible because of the cut away, but would align with the slot 24 of the magnet. The direction of magnetization is indicated by the arrows A in FIG. 2 and the slots are seen to be generally parallel to the magnet polarization direction.

In the copending application, the detrimental effects of eddy currents in the ferromagnetic components of a magnet structure are discussed. These include losses that are proportional to frequency and distortion that are due to the non-linear magnetic properties of the ferromagnetic components. Any energy that is diverted from, or coupled out of, the voice coil into other portions of the loudspeaker represents a potential reduction in accuracy of reproduction. Such occurs if the energy is: 1) either frequency selective, or 2) transferred into a non-linear material that, in turn, either recouples energy back into the voice coil or modulates the magnetic field. The present invention results from the discovery that the magnet itself, if fabricated from ceramic material, acts as a frequency selective non-linear energy sink. The distortions which result are much less when alnico magnets are used. Indeed it was the observation of the difference in distortion between otherwise identical speakers when a ceramic magnet was substituted for an alnico magnet which first called attention to this effect. A radial slot, introduced into the ceramic magnet so as to produce a magnetic discontinuity in the form of an air gap, reduces this distortion to levels equal to or lower than that of alnico magnets. Since alnico magnets are considerably more expensive than ceramic, the slotting of the ceramic is a cost effective improvement for reducing distortions.

FIG. 3 shows relative losses at different frequencies for an 8 inch driver with a 1 inch diameter voice coil of 8 ohm nominal impedance of conventional construction compared with the inventive constructions. The data for Table I was derived by measuring the external AC magnetic fields surrounding the speaker motors using 100 Hz for the prior art speaker as a reference in each case. The external AC magnetic fields from the slotted constructions were higher, which translates into lower internal magnetic losses. The loudspeakers with slotted ceramic magnets show the least losses at all frequencies. This is clearly evident in the audio reproduction of the loudspeakers constructed in this manner. Transient response is notably quicker and overall smear is reduced. Harmonic and ambient details, which are not resolved in the prior art construction, stand out dramatically.

The slotted magnet construction appears to lower distortion in at least two ways. The first is a reduction in "rocking motion" of the loudspeaker voice coil and cone. In the loudspeaker magnet constructions of the prior art, complex audio signals produce magnetic forces that have off-axis components which tilt the voice coil and thus set up rocking modes in the loudspeaker cone. This effect is particularly evident in dome transducers which do not incorporate a spider. The addition of a radial slot to the magnet significantly reduces rocking motion distortion in dome spiderless transducers. The second form of distortion reduction affects the transient response of the loudspeaker. In prior art constructions, the speaker transient response is degraded by losses in the magnets as shown in FIG. 3.

It is also well-known that increasing the magnet size for a given loudspeaker driver design makes the loudspeaker sound slower and less responsive. This has been attributed to the additional magnetic back EMF damping of the more powerful magnets. In reality, some of this effect is from increased coupled signal losses in the larger magnets, a fact which has heretofore not been recognized by the prior art. Slotting the magnets so as to interrupt AC magnetic flux paths, in accordance with the invention, eliminates these losses and enables high efficiency, large magnet structures to exhibit exemplary transient response.

FIG. 4 is a top view of a round transducer motor structure with only a single, aligned slot in each of the magnet and the top and bottom plates. For all but the most demanding applications, this construction represents a practical compromise in that these parts can be assembled on existing production lines without added fixtures. A pole piece 32 is centered within the opening of a top plate 34 forming an air gap 36. Magnet 38 is sandwiched between the top plate 34 and a bottom plate of similar configuration (not shown). A slot 40 is included in the magnet 38, in the top plate 34 and in the bottom plate. The slot in the plates extends from their outer circumferences to about the center hole 42 in the magnet 38. The width of the slots should be proportional to magnet size and generally range from approximately one-eighth to one-half inches. As will be discussed below, a plurality of U-shaped "bias" clips or shunts 31 are positioned around the periphery of the slotted magnet. While slots are effective in reducing energy loss in the magnet, making the slots too wide can result in a loss of efficiency. In the copending application, the slots are shown as extending completely through the plates. While that construction is satisfactory and produces great benefits, a partial slot in the plates, in conjunction with a slotted magnet, has been found to better optimize the uniformity of damping over a wider frequency range. Such a construction is also easier to fabricate.

Because of its optimized bass response and substantial reduction in intermodulation effects between bass and midrange information, a driver having the magnet construction of this invention permits designs in which the performance of a four-way sub-woofer system can be obtained from a three-way system at a considerable saving in cost (and space). When applied to full range loudspeakers, such as those generally used in television receivers, these improvements yield greatly extended bass along with improved dynamic range and clarity.

Figure 5:
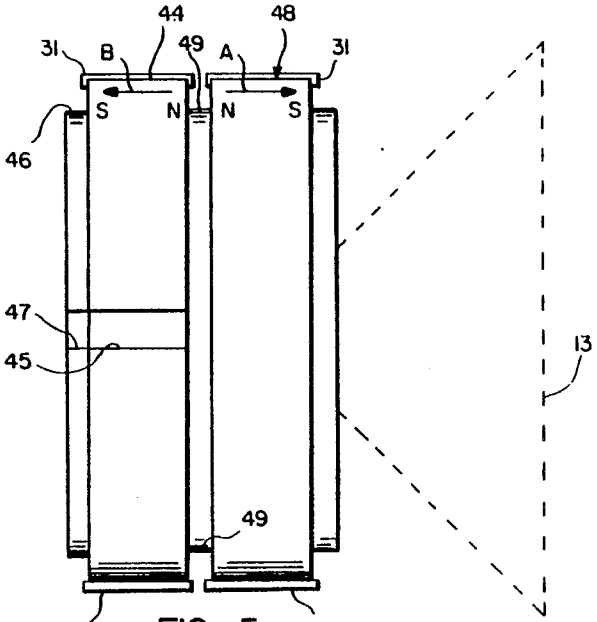
FIG. 5 is a representation of the invention utilized in a bucking magnet configuration with a conventional loudspeaker.

Slotted ceramic bucking magnets have also been found to yield significant benefits, both with conventional magnet constructions and with slotted constructions. A bucking magnet is a technique that has been used in the prior art to reduce the stray magnetic field from a loudspeaker. Such stray magnetic fields are of concern in television applications, for example. In FIG. 5, a ceramic bucking magnet 44, having a slot 45 in accordance with the invention, is shown positioned on the rear of a conventional loudspeaker magnet structure 48. With the polarities of the two magnets being S-N, N-S, the magnet 44 is bucking since the arrows B and A, respectively representing the magnetization directions, are opposed to each other. This arrangement has the surprising effect of producing a significant reduction in distortion from the prior art loudspeaker. The added bucking magnet is preferably, at least physically and magnetically, close in size and strength to the main magnet and may be attached to the back plate 49 of the magnet structure 48 by any suitable means, such as by gluing. In this connection an improved result may be obtained by fully slotting the magnet, i.e., partitioning it into two halves. Experiments have indicated that using additional magnets of three to four times the magnetic strength of the main magnet yields even greater benefits. An added benefit is obtained by adding to slotted bucking magnet 44, a back plate 46 having a slot 47 in alignment with slot 45. If magnet 44 is cut into two halves, as mentioned, back plate 46 should also be cut into two sections.

It has been found that a further reduction in distortion is obtained by biasing the slotted magnets with one or more external shunt magnetic paths. As shown, bias shunts, in the form of U-shaped clips 31, of magnetically permeable material are positioned about the peripheries of magnet 10 and bucking magnet 44. The shunts may also be straight, as shown at 31', and preferably extend a little beyond the magnet edges.

Experimentation led to a further discovery. A slotted bucking magnet and a slotted back plate 46 positioned as shown in FIG. 6 on a loudspeaker constructed with a slotted magnet and slotted plates in accordance with FIG. 2 of the invention, provided even more improvement in accuracy and clarity of reproduction and freedom from distortion than when used on a conventional magnet. Slot 45 in bucking magnet 44 is shown aligned with slot 24 in the magnet 10 and plates 12 and 14 of the FIG. 2 loudspeaker.

In FIG. 6, the shunts shown at the bottom comprise single strips of magnetically permeable material that bridge magnet 10 and bucking magnet 44. The shunts should not electrically connect the top and the bottom plates and may be fabricated from 0.040 to 0.125 thick steel. From 3–6 shunts, equally spaced around and bridging the perimeters of the main magnet and of the bucking magnet, will produce a reduction in distortion. The shunts should preferably be glued in place to prevent their being dislodged although the attraction of the magnet will hold them in position under normal usage.

The prior art has accepted that the high coercive force of a ceramic magnet results in magnetic stability. Thus it was quite unexpected to find that a typical loudspeaker magnetic circuit is in fact modulated by the AC field of the voice coil, with resultant distortion. Slotting the magnet greatly reduces this distortion. The added bias shunts offer an additional advantage by further stabilizing the operating point of the magnet by providing a flux path outside of, and thus not subject to, the AC modulating field of the voice coil. The greater the amount of flux that is diverted into these non-modulated paths, the lower the distortion. A point is reached, however, where efficiency is sacrificed. The desired result can be controlled by both the number and the thickness of material used for the bias shunts.

Figure 7:
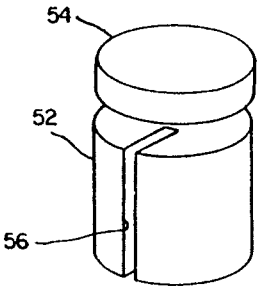
FIG. 7 is an exploded view of a slug magnet constructed in accordance with the invention.

In FIG. 7, a slug-type magnet 52 is illustrated in an exploded view to show a single radial slot 56. This construction will find application in loudspeakers with ceramic magnets having a cylindrical shape, rather than the more common doughnut or ring shape. While the slug construction lends itself to a more economical loudspeaker magnet structure, only recently have ceramic magnets of sufficiently powerful fields become available to permit their practical use in this configuration. In accordance with standard known practice, a magnetically permeable pole tip 54 is affixed to the end of magnet 52 that is closest to the loudspeaker cone (not shown). No slot is used in the pole tip 54 to avoid a discontinuity in the airgap.

Figure 8:
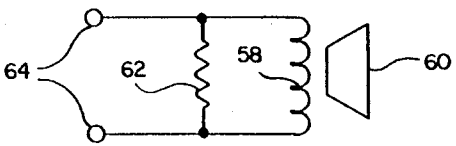
FIG. 8 is a circuit drawing of another aspect of the invention.

In FIG. 8, the driver voice coil 58, which drives a loudspeaker cone 60, has a fixed value damping resistor 62, directly connected across its input terminals 64. When the Q has to be lowered, as it might when a slotted bucking magnet is added, this resistor can be selected to set the driver Q to any value needed. Use of a damping resistor across the voice coil has added advantages besides control of Q. The damping resistor acts as a sink for back EMF currents which would otherwise be a problem for the driving amplifier to handle. In conjunction with the slotted magnet design, this resistor adds control and lowers dynamic distortion. The overall advantages of using a damping resistor are such that even sealed enclosure designs, for which higher driver Qs are needed should, include a damping resistor having a fixed value between 3 and 10 times the driver impedance. The resulting slight increase in amplifier current can usually be ignored. If it cannot, it can be readily compensated for by increasing the voice coil DC resistance.

The single slot in an electroacoustic transducer magnet offers improvements without production complications and can easily be produced when molding the magnet or may be formed later by cutting the magnet. When the partially slotted top and bottom plates are included, a new order of accuracy in loudspeaker reproduction is obtained. Adding a slotted bucking magnet contributes still further benefits at a slight additional cost, and the extra slotted back plate behind the bucking magnet may be added for applications where the ultimate in low end response, with transient accuracy, is desired.

What is claimed is:

1. An electroacoustic transducer comprising:

a magnetic structure including an electrically non-conductive ceramic permanent magnet defining a fixed magnetic field in an air gap;

an AC signal current carrying coil mounted for movement in said air gap, the signal current generating an AC magnetic field that undesirably interacts with said ceramic permanent magnet to produce distortion;

a top plate and a bottom plate sandwiching said ceramic permanent magnet and a substantially radial slot in said top plate, extending across the upper face of said ceramic permanent magnet; and at least one substantially radial slot in the body of said ceramic permanent magnet producing a magnetic discontinuity in said ceramic permanent magnet and extending substantially parallel to the direction of magnetization of said ceramic permanent magnet, for stabilizing said fixed magnetic field and thereby reducing said distortion.

2. The transducer of claim 1, further comprising a substantially radial slot in said bottom plate, extending across the lower face of said ceramic permanent magnet.

3. The transducer of claim 1 wherein said at least one substantially radial slot in said ceramic permanent magnet includes a plurality of slots extending substantially parallel to the direction of magnetization of said ceramic permanent magnet and dividing said ceramic permanent magnet into sections.

4. The transducer of claim 1 wherein said coil has terminals and wherein said transducer further includes a damping resistor connected across said terminals.

5. An electroacoustic transducer comprising:

a magnetic structure including a ceramic permanent magnet poled with a given direction of magnetization and sandwiched between a magnetically conductive top plate and a magnetically conductive bottom plate and defining a fixed magnetic field in an air gap;

an AC signal current carrying coil mounted for movement in said air gap, said AC signal current generating an AC magnetic field interacting with said ceramic permanent magnet and said top and said bottom plate to produce distortion;

slot means including at least one substantially radial slot formed in said ceramic permanent magnet extending parallel to said direction of magnetic and producing a magnetic discontinuity in said permanent magnet; and at least one radial slot, extending across the face of said ceramic permanent magnet, in each of said top plate and said bottom plate for stabilizing said fixed magnetic field and reducing said distortion.

6. The transducer of claim 5 wherein said radial slots in said bottom plate an said to plate are aligned with said substantially radial slot in said ceramic permanent magnet and of a length which approximately corresponds in the radial width of said ceramic permanent magnet.

7. The transducer of claim 5, further including at least one low reluctance magnetic path between said top plate and said bottom plate that is substantially removed from said AC magnetic field.

8. The transducer of claim 7 wherein said coil includes terminals and wherein said transducer further includes a damping resistor connected across said terminals.

9. An electroacoustic transducer comprising:

a magnetic structure including a ceramic permanent magnet defining a fixed magnetic field in an air gap;

a signal current carrying coil movably mounted in said air gap, said signal current generating an AC magnetic field that undesirably interacts with said fixed magnetic field to produce distortion; and a slotted ceramic bucking magnet in close proximity to said magnetic structure for reducing said distortion.

10. The transducer of claim 9, further including a damping resistor in shunt with said coil.

11. The transducer of claim 9, further including a separate slotted back plate mounted to the rear surface of said slotted ceramic bucking magnet, with the respective slots therein in alignment.

12. The transducer of claim 11 wherein said magnetic structure has a bottom plate, and further including at least one low reluctance magnetic path between said bottom plate and said separate slotted back plate that is substantially removed from said AC magnetic field.

13. The transducer of claim 12, further including at least one low reluctance magnetic path between said top plate, said bottom plate and said slotted back plate at points substantially removed from said AC magnetic field.

14. The transducer of claim 11 wherein said ceramic permanent magnet includes at least one substantially radial slot.

15. The transducer of claim 14 wherein said magnet structure further includes a top plate which, with said bottom plate, sandwiches said ceramic permanent magnet; and at least one slot in each of said top and bottom plates extending across the respective faces of said ceramic permanent magnet in alignment with said substantially radial slot in said ceramic permanent magnet.

* * * * *

UNITED STATES PATENT AND TRADEMARK OFFICE

CERTIFICATE OF CORRECTION

PATENT NO. : 5,070,530

DATED : December 3, 1991

INVENTOR(S) : Robert M. Grodinsky & David G. Cornwell

It is certified that error appears in the above-identified patent and that said Letters Patent is hereby corrected as shown below:

Column 7, line 50, delete " magnetic " , insert --magnetization--;

Column 8, line 4, delete "an", insert --and--;

delete "to", insert --top--;

line 6, delete "in", insert --to--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*